US009033434B2

(12) United States Patent
Kruse et al.

(10) Patent No.: US 9,033,434 B2
(45) Date of Patent: May 19, 2015

(54) DRAWER GLIDE

(71) Applicant: Sauder Woodworking Co., Archbold, OH (US)

(72) Inventors: Amy L. Kruse, Defiance, OH (US); Ronald D. Roth, Wauseon, OH (US); George Snyder, Grand Rapids, MI (US); Terry W. Armey, Napoleon, OH (US); Chun Chun Tsai, Jiangsu (TW)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 14/302,700

(22) Filed: Jun. 12, 2014

(65) Prior Publication Data

US 2015/0091429 A1 Apr. 2, 2015

Related U.S. Application Data

(60) Provisional application No. 61/884,316, filed on Sep. 30, 2013, provisional application No. 61/892,722, filed on Oct. 18, 2013.

(51) Int. Cl.
*A47B 88/14* (2006.01)
*A47B 88/04* (2006.01)

(52) U.S. Cl.
CPC ..... *A47B 88/14* (2013.01); *A47B 88/04* (2013.01); *A47B 88/0466* (2013.01)

(58) Field of Classification Search
CPC ..... A47B 2210/0059; A47B 88/08; A47B 88/10; A47B 88/14; A47B 88/04; A47B 88/0466
USPC ..... 312/334.1, 334.7, 334.8, 334.12, 312/334.18, 334.19, 334.21, 334.39, 312/334.41, 334.42, 334.43, 334.45; 384/19, 21
See application file for complete search history.

(56) References Cited

U.S. PATENT DOCUMENTS

| | | | | | |
|---|---|---|---|---|---|
| 2,318,800 | A | * | 5/1943 | Rakow | 384/19 |
| 2,418,244 | A | * | 4/1947 | McKinley | 312/334.19 |
| 4,121,878 | A | * | 10/1978 | Lokken | 312/334.45 |
| 4,370,007 | A | * | 1/1983 | Fler | 312/334.11 |
| 4,564,248 | A | * | 1/1986 | Grass | 384/19 |
| 4,696,582 | A | * | 9/1987 | Kasten | 384/18 |
| 4,927,216 | A | * | 5/1990 | Boda | 312/334.12 |
| 4,962,974 | A | * | 10/1990 | Fitz | 312/333 |
| RE34,108 | E | * | 10/1992 | Grass | 384/19 |
| 5,490,724 | A | * | 2/1996 | Domenig | 312/334.45 |
| 5,580,174 | A | | 12/1996 | Houck | |
| 5,641,216 | A | | 6/1997 | Grass | |
| 5,692,816 | A | | 12/1997 | Lai | |
| 5,785,400 | A | | 7/1998 | Grieser et al. | |
| 5,876,103 | A | * | 3/1999 | Domenig | 312/334.4 |
| 6,129,432 | A | * | 10/2000 | Pollard | 312/330.1 |
| 6,378,969 | B1 | * | 4/2002 | Ferrari et al. | 312/334.44 |

(Continued)

*Primary Examiner* — Janet M Wilkens
(74) *Attorney, Agent, or Firm* — MacMillan, Sobanski & Todd, LLC

(57) ABSTRACT

A drawer glide having, among other things, a cabinet rail that includes a glide member and a wheel housing. The drawer glide further includes a drawer rail having a wheel and a glide lip. In operation, the cabinet rail is positioned on a cabinet and the drawer rail is positioned on a drawer. When the drawer is opened, the glide lip travels along the glide member and the wheel travels along the wheel housing. The drawer glide prevents slop, eliminates racking, increases drag and reduces noise. Further, the drawer glide is relatively easy to install on an article, such as RTA furniture.

20 Claims, 4 Drawing Sheets

(56) References Cited

U.S. PATENT DOCUMENTS 6,585,336 B2 7/2003 Munday et al.
6,619,771 B2 * 9/2003 Kueng et al. ..... 312/334.1
6,848,760 B2 2/2005 Thomas et al.
6,902,245 B1 6/2005 Hoeppner
2012/0319549 A1 12/2012 Hoeft

* cited by examiner

DRAWER GLIDE

TECHNICAL FIELD

This invention relates generally to hardware. More specifically, the invention is directed to drawer glides.

BACKGROUND OF THE INVENTION

Many drawer glides do not allow for the efficient opening and closing of a drawer. For example, some glides are "sloppy" in that they allow the drawer to move laterally within a cabinet. This often results in racking during opening and closing. There are also glides that do not provide enough drag on the drawer during opening, which can result in cascading. Moreover, some glides are noisy during operation. With respect to ready-to-assemble ("RTA") furniture, some glides are often difficult to assemble.

BRIEF SUMMARY OF THE INVENTION

This invention overcomes the above-identified issues by providing a drawer glide that allows for the efficient opening and closing of a drawer. For example, the drawer glide has, among other things, a cabinet rail that includes a glide member and a wheel housing. The drawer glide further includes a drawer rail having a wheel and a glide lip. In operation, the cabinet rail is positioned on a cabinet and the drawer rail is positioned on a drawer. When the drawer is opened, the glide lip travels along the glide member and the wheel travels along the wheel housing. The drawer glide prevents slop, eliminates racking, increases drag and reduces noise. Further, the drawer glide is relatively easy to install on an article, such as RTA furniture.

DETAILED DESCRIPTION OF THE INVENTION

Figure 1:
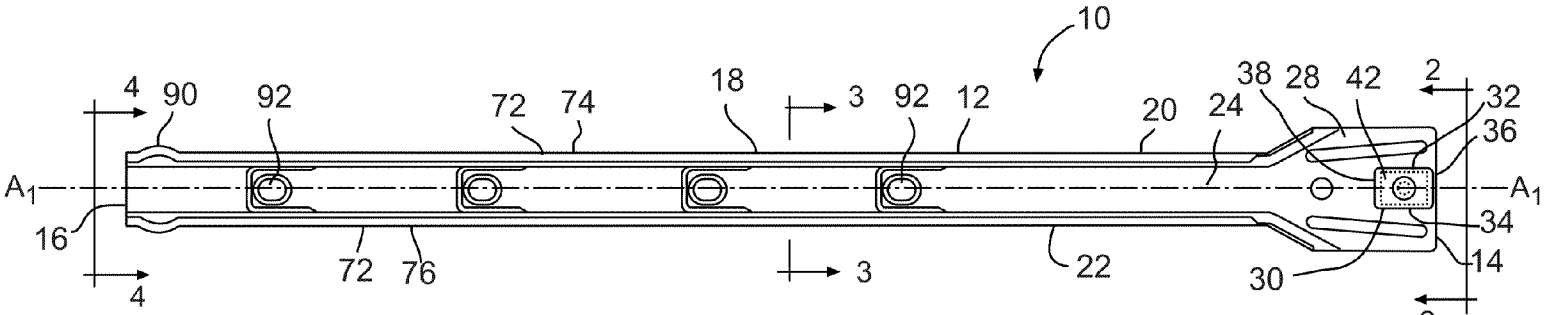
FIG. 1 is a side elevational view of an embodiment of a cabinet rail according to the invention.

The invention will now be described in detail with reference being made to the accompanying drawings. In the drawings, an embodiment of the drawer glide according to the invention is indicated generally by the reference number "10."

Referring to FIGS. 1-4, the drawer glide 10 has a cabinet rail 12 that is configured for positioning on any article that includes moving or sliding parts such as drawers. For example, the cabinet rail 12 can be configured for positioning on an article of furniture such as dresser that contains one or more drawers. The furniture article can be, for example, RTA furniture that is sold unassembled for final assembly by a consumer or user of the furniture. The cabinet rail 12 is universal in that it can be used, for example, on either side of the furniture article.

Still referring to FIGS. 1-4 and 11, the cabinet rail 12 has a cabinet rail front end 14, a cabinet rail back end 16, a cabinet rail body 18 that extends longitudinally between the front and back ends 14 and 16, a cabinet rail first portion 20, a cabinet rail second portion 22, a cabinet rail interior surface 24 and a cabinet rail exterior surface 26. The front end 14 includes a flared portion 28. A glide member 30 is positioned on the flared portion 28 along the longitudinal axis $A_1$ of the cabinet rail 12. In an embodiment, the glide member 30 includes a glide member first surface 32, a glide member second surface 34, a glide member front surface 36, a glide member back surface 38, a glide member interior surface 40 and a glide member exterior surface 42. In an embodiment, each of the surfaces 32, 34, 36 and 38 is substantially straight or planar. In an embodiment, the glide member first and second surfaces 32 and 34 are of equal length and parallel. In an embodiment, the glide member front and back surfaces 36 and 38 are of equal length and parallel. In an embodiment, the lengths of the surfaces 32 and 34 are greater than the lengths of the surfaces 36 and 38.

Figure 2:
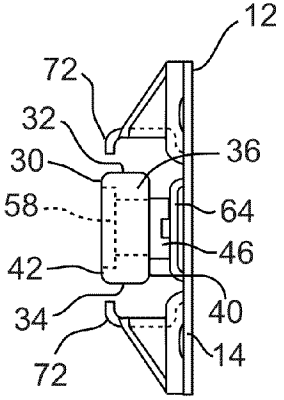
FIG. 2 is a front elevational view taken along line 2-2 of FIG. 1.
Figure 11:
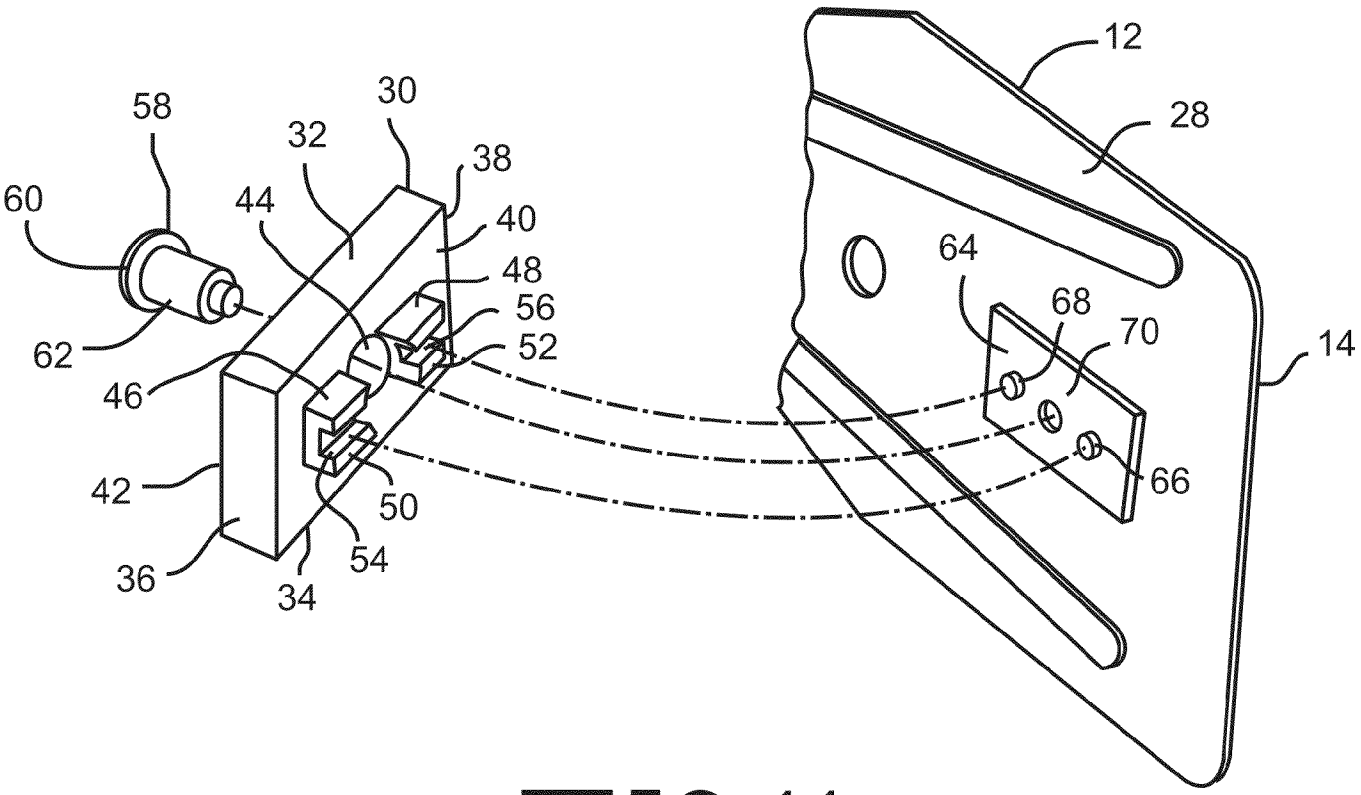
FIG. 11 is a perspective view of an embodiment of a glide member and cabinet rail according to the invention.

As shown in FIGS. 1, 2 and 11, the glide member 30 defines a glide member pin opening 44 that extends between the interior and exterior surfaces 40 and 42. A glide member first leg 46 and a glide member second leg 48 extend outwardly from the interior surface 40. The first leg 46 is positioned on one side of the opening 44 adjacent to the front surface 36 and the second leg 48 is positioned on the other side of the opening 44 adjacent to the back surface 38. The first leg 46 has a first leg foot 50 and the second leg 48 has a second leg foot 52. The first leg 46 defines a first leg projection recess 54 adjacent to the first leg foot 50 and the second leg 48 defines a second leg projection recess 56 adjacent to the second leg foot 52.

Still referring to FIGS. 1, 2 and 11, the glide member 30 is positioned on the cabinet rail 12 by a glide member pin 58. In an embodiment, the pin 58 has a head 60 that is positioned adjacent to the exterior surface 42 and a stem 62 that extends through the opening 44 and thus between the first and second legs 46 and 48. The pin 58 is fixedly attached to the cabinet rail 12.

As shown in FIGS. 2 and 11, the cabinet rail 12 includes a leg engagement portion 64 positioned adjacent to the pin 58 that is configured to restrict movement of the first and second legs 46 and 48. In an embodiment, the leg engagement portion 64 includes a first leg projection 66 that is configured for positioning in the first leg projection recess 54 and a second leg projection 68 that is configured for positioning in the second leg projection recess 56. Further, the leg engagement portion 64 includes a leg engagement surface 70 that is configured to engage the first and second leg feet 50 and 52.

Referring to FIGS. 1, 2 and 11, the glide member 30 can partially rotate or move on the pin 58. In this regard, the first and second leg projections 66 and 68 restrict rotational movement by engaging the glide member 30 in the first and second leg projection recesses 54 and 56, respectively. Further, the leg engagement surface 70 engages the first and second feet 50 and 52 to restrict movement of the glide member 30. This allows for rocking or wobbling movement of the glide member 30 with respect to the cabinet rail interior surface 24.

Figure 3:
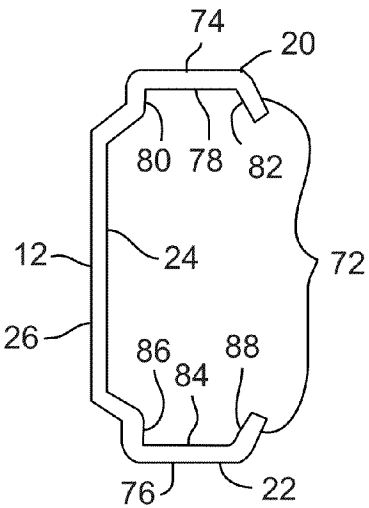
FIG. 3 is a cross-sectional view taken along line 3-3 of FIG. 1.

Referring to FIGS. 1-4, the cabinet rail 12 is configured to provide a wheel housing 72 along which a wheel can travel, as described below. In an embodiment, the wheel housing 72 has a first capture member 74 that projects outwardly from the cabinet rail interior surface 24 adjacent to the cabinet rail first portion 20 and a second capture member 76 that projects outwardly from the cabinet rail interior surface 24 adjacent to the cabinet rail second portion 22 in an opposed and spaced relationship to one another. As shown in FIG. 3, the first capture member 74 includes a first capture member wheel surface 78 that extends between a first capture member inner wheel surface 80 and a first capture member outer wheel surface 82. The inner and outer wheel surfaces 80 and 82 are spaced and opposed to one another. Still referring to FIG. 3, the second capture member 76 includes a second capture member wheel surface 84 that extends between a second capture member inner wheel surface 86 and a second capture member outer wheel surface 88. The inner and outer wheel surfaces 86 and 88 are spaced and opposed to one another. As shown in FIG. 3, the first and second member wheel surfaces 78 and 84 are spaced and opposed to one another. In an embodiment, the housing 72 is "full capture" because the surfaces 78, 80, 82, 84, 86 and 88 act to capture or contain a wheel as it travels along or through the housing 72. In an embodiment, the housing 72 extends longitudinally from the flared portion 28 of the cabinet rail front end 14 to the cabinet rail back end 16.

Figure 4:
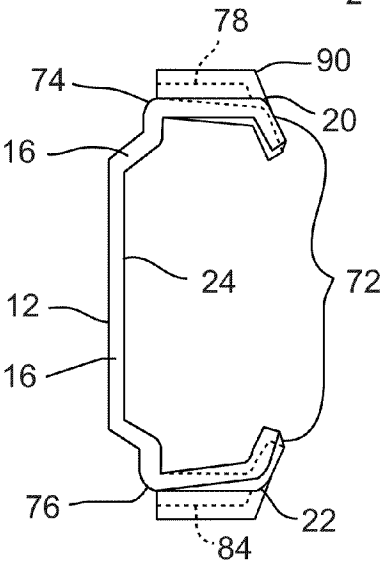
FIG. 4 is a back elevational view taken along line 4-4 of FIG. 1.

Referring to FIGS. 1 and 4, the cabinet rail 12 is configured for positioning or seating a wheel, as described below. In an embodiment, the first and second capture members 74 and 76 are configured to form a wheel pocket 90 adjacent to the cabinet rail back end 16. In this regard, the first capture member 74 extends outwardly from the cabinet rail first portion 20 and the first capture member wheel surface 78 is enlarged or rounded. Likewise, the second capture member 76 extends outwardly from the cabinet rail second portion 22 and the second capture member wheel surface 84 is enlarged or rounded.

As shown in FIGS. 1 and 2, the cabinet rail 12 is configured for positioning on, for example, a cabinet of a dresser. In an embodiment, the cabinet rail 12 includes one or more openings 92 through which fasteners can extend for attachment to the cabinet. The cabinet rail 12 can be made from a variety of suitable materials. For example, the cabinet rail body 18 and the glide member pin 58 can be made of metal and the glide member 30 can be made of plastic for, among other things, strength, durability and cost.

Figure 5:
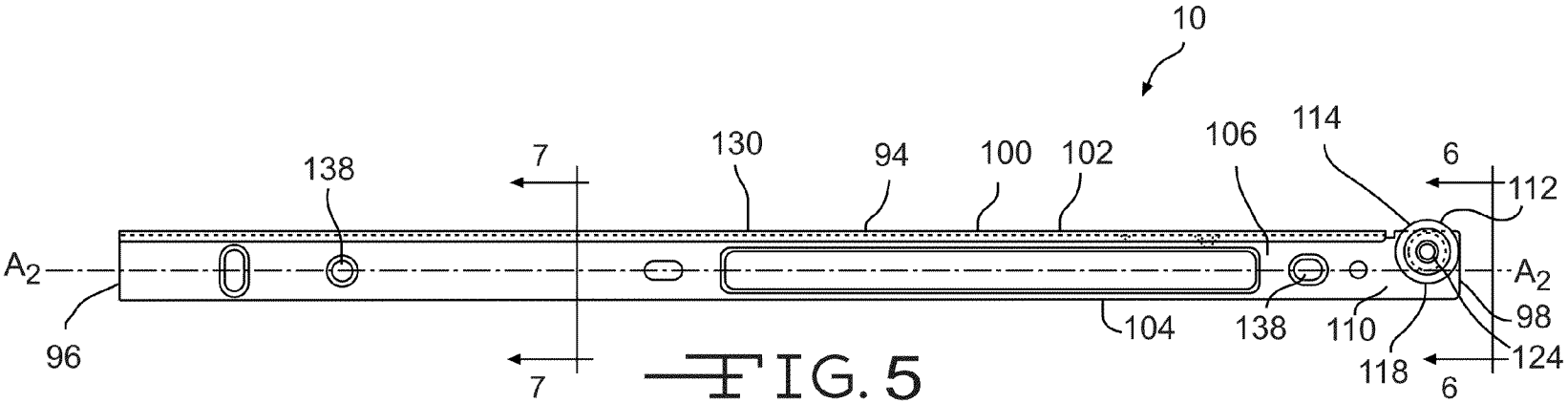
FIG. 5 is a side elevational view of an embodiment of a drawer rail according to the invention.
Figure 7:
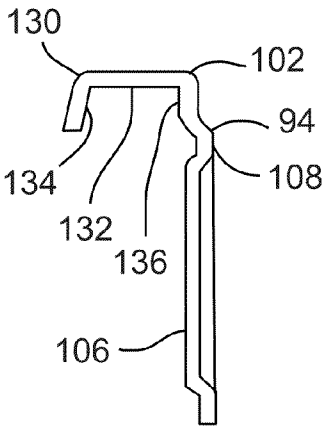
FIG. 7 is a cross-sectional view taken along line 7-7 of FIG. 5.
Figure 6:
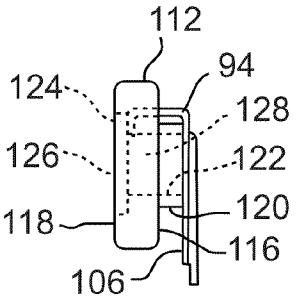
FIG. 6 is a back elevational view taken along line 6-6 of FIG. 5.

Referring to FIGS. 5-7, the drawer glide 10 has a drawer rail 94 that is configured for positioning on, for example, a drawer of a dresser. The drawer rail 94 has a drawer rail front end 96, a drawer rail back end 98, a drawer rail body 100 that extends longitudinally between the front and back ends 96 and 98, a drawer rail first portion 102, a drawer rail second portion 104, a drawer rail interior surface 106 and a drawer rail exterior surface 108. The back end 98 includes an open portion 110. A wheel 112 is positioned on the open portion 110 away from the longitudinal axis $A_2$ of the drawer rail 94 adjacent to the first portion 102. In an embodiment, the wheel 112 has a substantially circular shape that includes a housing engagement surface 114. The wheel 112 further includes a wheel interior surface 116 and a wheel exterior surface 118. A wheel spacer member 120 projects outwardly from the interior surface 116.

As shown in FIGS. 5 and 6, the wheel 112 defines a wheel pin opening 122 that extends between the interior and exterior surfaces 116 and 118. The wheel 112 is positioned on the drawer rail 94 by a wheel pin 124. In an embodiment, the pin 124 has a head 126 that is positioned adjacent to the exterior surface 118 and a stem 128 that extends through the opening 122. The pin 124 is fixedly attached to the drawer rail 94. The wheel spacer member 120 spaces the wheel 112 from the drawer rail interior surface 106. In an embodiment, the wheel 112 is stationary. In this regard, the wheel 112 does not rotate or otherwise move in relation to the pin 124.

Referring again to FIGS. 5-7, the drawer rail 94 is configured to provide a glide lip 130 that travels along the glide member 30 of the cabinet rail 12, as described below. In an embodiment, the glide lip 130 projects outwardly from the drawer rail interior surface 106 adjacent to the drawer rail first portion 102. As shown in FIG. 7, the glide lip 130 includes a glide member surface 132 that extends between an outer glide surface 134 and an inner glide surface 136. The inner and outer glide surfaces 134 and 136 are spaced and opposed to one another. The surfaces 132, 134 and 136 act to guide the glide lip 130 as it travels along the glide member 30.

As shown in FIG. 5, the drawer rail 94 includes one or more openings 138 through which fasteners can extend for attachment to the drawer. The drawer rail 94 can be made from a variety of suitable materials. For example, the drawer rail body 100 and the wheel pin 124 can be made of metal and the wheel 112 can be made of plastic for, among other things, strength, durability and cost.

Figure 8:
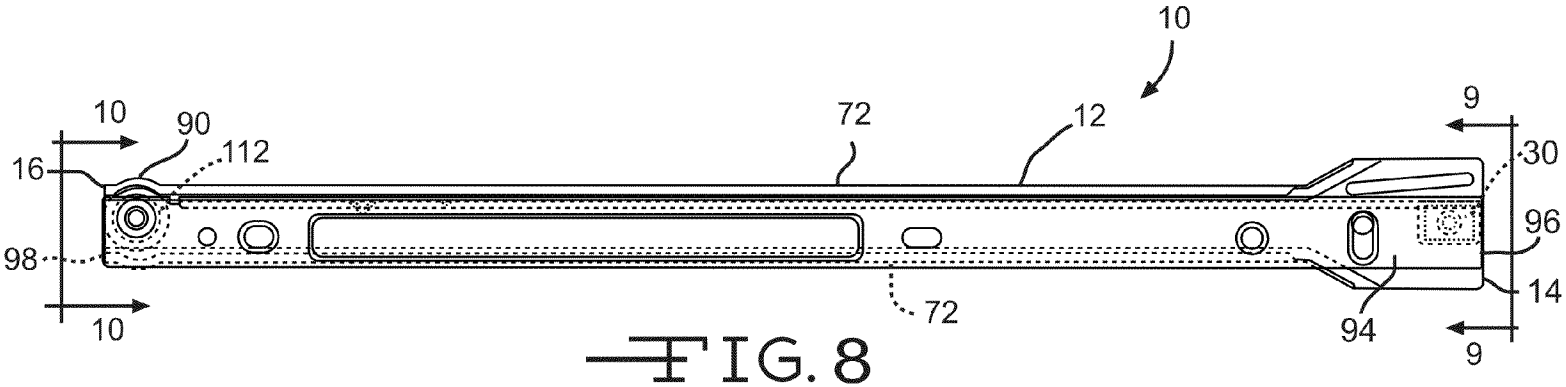
FIG. 8 is a side elevational view of an embodiment of a drawer glide according to the invention.
Figure 9:
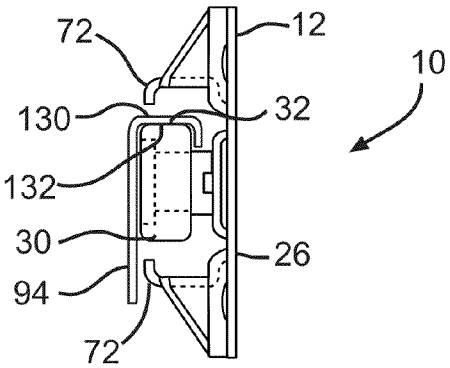
FIG. 9 is a front elevational view taken along line 9-9 of FIG. 8.
Figure 10:
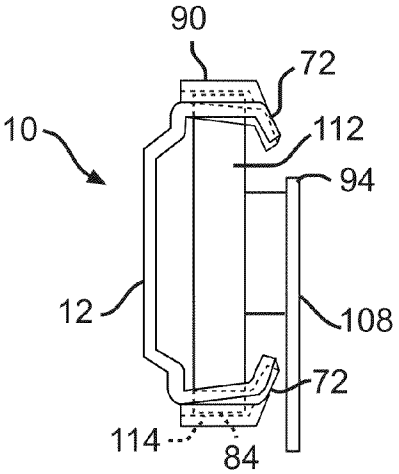
FIG. 10 is a back elevational view taken along line 10-10 of FIG. 8.

Referring to FIGS. 2-4, 6, 7 and 8-10, the assembly and operation of the drawer glide 10 will be described. For example, the drawer glide 10 will described in relation to RTA furniture. To install a drawer in a cabinet, the consumer or user positions a cabinet rail 12 on an interior surface of the cabinet in which the cabinet rail front end 14 is positioned adjacent to the front of the cabinet and the cabinet rail back end 16 is positioned adjacent to the back of the cabinet. The cabinet rail exterior surface 26 is positioned adjacent to the cabinet. Because the cabinet rail 12 is universal, as described above, the cabinet rail 12 can be mounted on either the right side or the left side of the cabinet. A drawer rail 94 is positioned on an exterior side surface of the drawer in which the drawer rail front end 96 is positioned adjacent to the front of the drawer and the drawer rail back end 98 is positioned adjacent to the back of the drawer. The drawer rail 94 is configured for positioning on either the right side or the left side of the drawer. A right side drawer rail 94 is shown in FIGS. 8-10. A left side drawer rail includes all of the elements as described above with respect to the right side drawer rail 94.

When the cabinet rail 12 and the drawer rail 94 are positioned, the drawer is installed in the cabinet by inserting the wheel 112 of the drawer rail 94 in the wheel housing 72 of the cabinet rail 12. In this regard, the housing engagement surface 114 of the wheel 112 engages one or more of the surfaces 78, 80, 82, 84, 86 and 88 of the housing 72. The glide member first surface 32 of the glide member 30 engages the glide member surface 132 of the glide lip 130 (the second glide surface 34 would be so engaged on a left side drawer rail), the glide member interior surface 40 engages the outer glide surface 134 and the glide member exterior surface 42 engages the inner glide surface 136. The wheel 112 can be seated in the wheel pocket 90.

The drawer glide 10 allows for the efficient opening and closing of the drawer. During operation, the glide lip 130 travels along the glide member 30 and the wheel 112 travels along the wheel housing 72. This prevents slop, eliminates racking, increases drag and reduces noise during the opening and closing of the drawer. Further, the drawer glide 10 is relatively easy to install on an article, such as RTA furniture.

Certain embodiments of the apparatus disclosed herein are defined in various examples. It should be understood that these examples, while indicating particular embodiments of the invention, are given by way of illustration only. From the above discussion and these examples, one skilled in the art can ascertain the essential characteristics of this disclosure, and without departing from the spirit and scope thereof, can make various changes and modifications to adapt the compositions and methods described herein to various usages and conditions. Various changes may be made and equivalents may be substituted for elements thereof without departing from the essential scope of the disclosure. In addition, many modifications may be made to adapt a particular situation or material to the teachings of the disclosure without departing from the essential scope thereof.

What is claimed is:

1. A drawer glide comprising:

a cabinet rail having a cabinet front end and a cabinet back end, a glide member being positioned adjacent to the cabinet front end and a wheel housing extending longitudinally between the cabinet front and back ends, the glide member having a substantially straight surface; and a drawer rail having a drawer front end and a drawer back end, a wheel being positioned adjacent to the drawer back end, and a glide lip extending longitudinally between the drawer front and back ends, the cabinet rail and the drawer rail being configured to allow the glide lip to travel along the straight surface of the glide member and the wheel to travel along the wheel housing.

2. The drawer glide of claim 1, wherein the cabinet rail is universal.

3. The drawer glide of claim 1, wherein the cabinet rail has a flared portion positioned adjacent to the cabinet front end.

4. The drawer glide of claim 3, wherein the glide member is positioned on the flared portion.

5. The drawer glide of claim 1, wherein the glide member is positioned substantially along the longitudinal axis of the cabinet rail.

6. The drawer glide of claim 1, wherein the glide member has two straight surfaces configured to engage the glide lip.

7. The drawer glide of claim 1, wherein the glide member has first and second legs configured to engage a portion of the cabinet rail to restrict movement of the glide member on the cabinet rail.

8. The drawer glide of claim 7, wherein the first and second legs have first and second leg projection recesses, respectively, and the cabinet rail has first and second leg projections configured for positioning in the first and second leg projection recesses, respectively.

9. The drawer glide of claim 7, wherein the first and second legs have first and second leg feet, respectively, and the cabinet rail has a surface configured to engage the first and second leg feet.

10. The drawer glide of claim 1, wherein the wheel housing has first and second capture members configured to capture the wheel.

11. The drawer glide of claim 10, wherein each of the first and second capture members has a surface configured to engage the wheel.

12. The drawer glide of claim 10, wherein the first and second capture members are configured to form a wheel pocket adjacent to the cabinet back end.

13. The drawer glide of claim 1, wherein the drawer rail has an open portion positioned adjacent to the drawer rail back end, the wheel being positioned on the open portion.

14. The drawer glide of claim 1, wherein the wheel is substantially stationary on the drawer rail.

15. The drawer glide of claim 1, wherein the wheel has a substantially circular shape.

16. The drawer glide of claim 1, wherein the wheel is positioned adjacent to the top of the drawer rail.

17. The drawer glide of claim 1, wherein the glide lip has a surface configured to engage the glide member.

18. A drawer glide comprising:

a cabinet rail having a cabinet front end and a cabinet back end, a glide member being positioned adjacent to the cabinet front end and a wheel housing extending longitudinally between the cabinet front and back ends, the glide member having first and second legs configured to engage a portion of the cabinet rail to restrict movement of the glide member on the cabinet rail; and a drawer rail having a drawer front end and a drawer back end, a wheel being positioned adjacent to the drawer back end, and a glide lip extending longitudinally between the drawer front and back ends, the cabinet rail and the drawer rail being configured to allow the glide lip to travel along the glide member and the wheel to travel along the wheel housing.

19. A drawer glide comprising:

a cabinet rail having a cabinet front end and a cabinet back end, a glide member being positioned adjacent to the cabinet front end and a wheel housing extending longitudinally between the cabinet front and back ends, the glide member having first and second legs configured to engage a portion of the cabinet rail to restrict movement of the glide member on the cabinet rail, the first and second legs having first and second leg projection recesses, respectively, and the cabinet rail having first and second leg projections configured for positioning on the first and second leg projection recesses, respectively; and a drawer rail having a drawer front end and a drawer back end, a wheel being positioned adjacent to the drawer back end, and a glide lip extending longitudinally between the drawer front and back ends, the cabinet rail and the drawer rail being configured to allow the glide lip to travel along the glide member and the wheel to travel along the wheel housing.

20. A drawer glide comprising:

a cabinet rail having a cabinet front end and a cabinet back end, a glide member being positioned adjacent to the cabinet front end and a wheel housing extending longitudinally between the cabinet front and back ends the glide member having first and second legs configured to engage a portion of the cabinet rail to restrict movement of the glide member on the rail, the first and second legs having first and second leg feet, respectively, and the cabinet rail having a surface configured to engage the first and second leg feet; and a drawer rail having a drawer front end and a drawer back end, a wheel being positioned adjacent to the drawer back end, and a glide lip extending longitudinally between the drawer front and back ends, the cabinet rail and the drawer rail being configured to allow the glide lip to travel along the glide member and the wheel to travel along the wheel housing.

* * * * *